US007348949B2

(12) United States Patent
Lee et al.

(10) Patent No.: US 7,348,949 B2
(45) Date of Patent: Mar. 25, 2008

(54) METHOD AND APPARATUS FOR CONTROLLING AN LED BASED LIGHT SYSTEM

(75) Inventors: Joon Chok Lee, Sarawak (MY); Kevin Len Li Lim, Perak (MY); Rizal Bin Jaffar, Melaka (MY)

(73) Assignee: Avago Technologies ECBU IP Pte Ltd, Singapore (SG)

( * ) Notice: Subject to any disclaimer, the term of this patent is extended or adjusted under 35 U.S.C. 154(b) by 688 days.

(21) Appl. No.: 10/799,216

(22) Filed: Mar. 11, 2004

(65) Prior Publication Data

US 2005/0200578 A1 Sep. 15, 2005

(51) Int. Cl.
*G09G 3/32* (2006.01)
*G09G 3/36* (2006.01)

(52) U.S. Cl. ..... 345/83; 345/102

(58) Field of Classification Search ..... 345/76, 345/82–84, 102, 581, 589; 315/291, 312
See application file for complete search history.

(56) References Cited

U.S. PATENT DOCUMENTS 5,497,465 A * 3/1996 Chin et al. ..... 710/100
5,592,193 A * 1/1997 Chen ..... 345/102
6,069,676 A * 5/2000 Yuyama ..... 349/62
6,115,016 A * 9/2000 Yoshihara et al. ..... 345/88
6,243,067 B1 * 6/2001 Noguchi et al. ..... 345/102
6,448,951 B1 * 9/2002 Sakaguchi et al. ..... 345/88
6,495,964 B1 * 12/2002 Muthu et al. ..... 315/149
6,507,159 B2 1/2003 Muthu
6,521,879 B1 * 2/2003 Rand et al. ..... 250/205
6,566,689 B2 * 5/2003 Hoelen et al. ..... 257/89
6,608,453 B2 * 8/2003 Morgan et al. ..... 315/312
6,608,614 B1 * 8/2003 Johnson ..... 345/102
6,611,000 B2 * 8/2003 Tamura et al. ..... 257/80
6,637,905 B1 10/2003 Ng et al.
6,682,331 B1 1/2004 Peh et al.
6,744,416 B2 * 6/2004 Mizutani et al. ..... 345/88
6,870,525 B2 * 3/2005 Kawabata et al. ..... 345/102
7,002,546 B1 * 2/2006 Stuppi et al. ..... 345/102
7,126,576 B2 * 10/2006 Kim et al. ..... 345/102
7,202,613 B2 * 4/2007 Morgan et al. ..... 315/312
7,233,304 B1 * 6/2007 Aratani et al. ..... 345/87
7,248,244 B2 * 7/2007 Akiyama ..... 345/102
2001/0035853 A1 * 11/2001 Hoelen et al. ..... 345/102
2002/0067332 A1 * 6/2002 Hirakata et al. ..... 345/102
2003/0043107 A1 * 3/2003 Ruby et al. ..... 345/102
2003/0076056 A1 4/2003 Schuurmans
2003/0214725 A1 * 11/2003 Akiyama ..... 359/640
2003/0230991 A1 12/2003 Muthu et al.
2004/0017348 A1 * 1/2004 Numao ..... 345/92
2004/0113044 A1 * 6/2004 Ishiguchi ..... 250/205
2004/0125062 A1 * 7/2004 Yamamoto et al. ..... 345/87
2005/0117190 A1 * 6/2005 Iwauchi et al. ..... 359/237
2005/0134197 A1 * 6/2005 Lee et al. ..... 315/291
2005/0253921 A1 * 11/2005 Groeger ..... 347/229
2005/0259064 A1 * 11/2005 Sugino et al. ..... 345/102

* cited by examiner

*Primary Examiner*—Sumati Lefkowitz
*Assistant Examiner*—Rodney Amadiz

(57) ABSTRACT

A technique for controlling a Light Emitting Diode (LED) based light system involves driving individual light sources that make up the LED-based light system at non-overlapping intervals so that light source-specific feedback signals can be generated in response to the emitted light. The light source-specific feedback signals are then used to individually adjust the light sources to achieve desired luminance and chrominance characteristics of the emitted light.

20 Claims, 5 Drawing Sheets

METHOD AND APPARATUS FOR CONTROLLING AN LED BASED LIGHT SYSTEM

BACKGROUND OF THE INVENTION

Light Emitting Diodes (LEDs) have sparked interest in their use for illumination. Unlike incandescent light sources, which are broadband blackbody radiators, LEDs produce light of relatively narrow spectra, governed by the bandgap of the semiconductor material used to fabricate the device. One way of making a white light source using LEDs combines Red, Green, and Blue (RGB) LEDs to produce mixed (e.g., white) light. Slight differences in the relative amounts of each color of the RGB based light source manifest as a color shift in the light. Use of an RGB based light source to replace existing light sources requires that the color of the light be controlled and constant over the lifetime of the unit.

RGB based light sources are widely used for Liquid Crystal Display (LCD) back-lighting, commercial freezer lighting, white light illumination, and other applications. Some applications require more careful control of spectral content than others and differing color temperatures may be desired for different applications. For careful control of spectral content, feedback control mechanisms are sometimes used to ameliorate differences between LEDs. Such differences may be due to the aging of the LEDs, variations in temperature, or shifts in drive currents. Even LEDs manufactured by nominally identical processes often have slight variations vis-à-vis one another.

Unfortunately, light guide design becomes increasingly complex, and accurate feedback increasing problematic, as display panels increase in size or incorporate multiple light sources. When a light guide is large, as may be the case for sizeable LCD panels or window glass, ensuring adequate color uniformity across a display is a significant challenge. Moreover, for light guides designed to transport light from multiple sources to a feedback point, careful light guide panel design is required to couple the light output from each light source to the feedback point.

SUMMARY OF THE INVENTION

A technique for controlling a Light Emitting Diode (LED) based light system involves driving individual light sources that make up the LED-based light system at non-overlapping intervals so that light source-specific feedback signals can be generated in response to the emitted light. The light source-specific feedback signals are then used to individually adjust the light sources to achieve desired luminance and chrominance characteristics of the emitted light. Individually adjusting the light sources of an LED-based light system in response to light source-specific feedback signals improves color uniformity and consistency across the light system. Color uniformity and consistency are especially important in applications such as LCD backlighting.

A system constructed according to the technique includes feedback units for generating feedback signals representative of luminance and chrominance characteristics over non-overlapping intervals associated with light source assemblies. A non-overlapping interval is associated with both a feedback unit and a light source assembly. A controller provides control signals to a light source assembly during the non-overlapping interval associated with the light source assembly. The controller adjusts the control signals according to the feedback.

BRIEF DESCRIPTION OF THE DRAWINGS

Throughout the description, similar reference numbers may be used to identify similar elements.

DETAILED DESCRIPTION OF THE INVENTION

Figure 1:
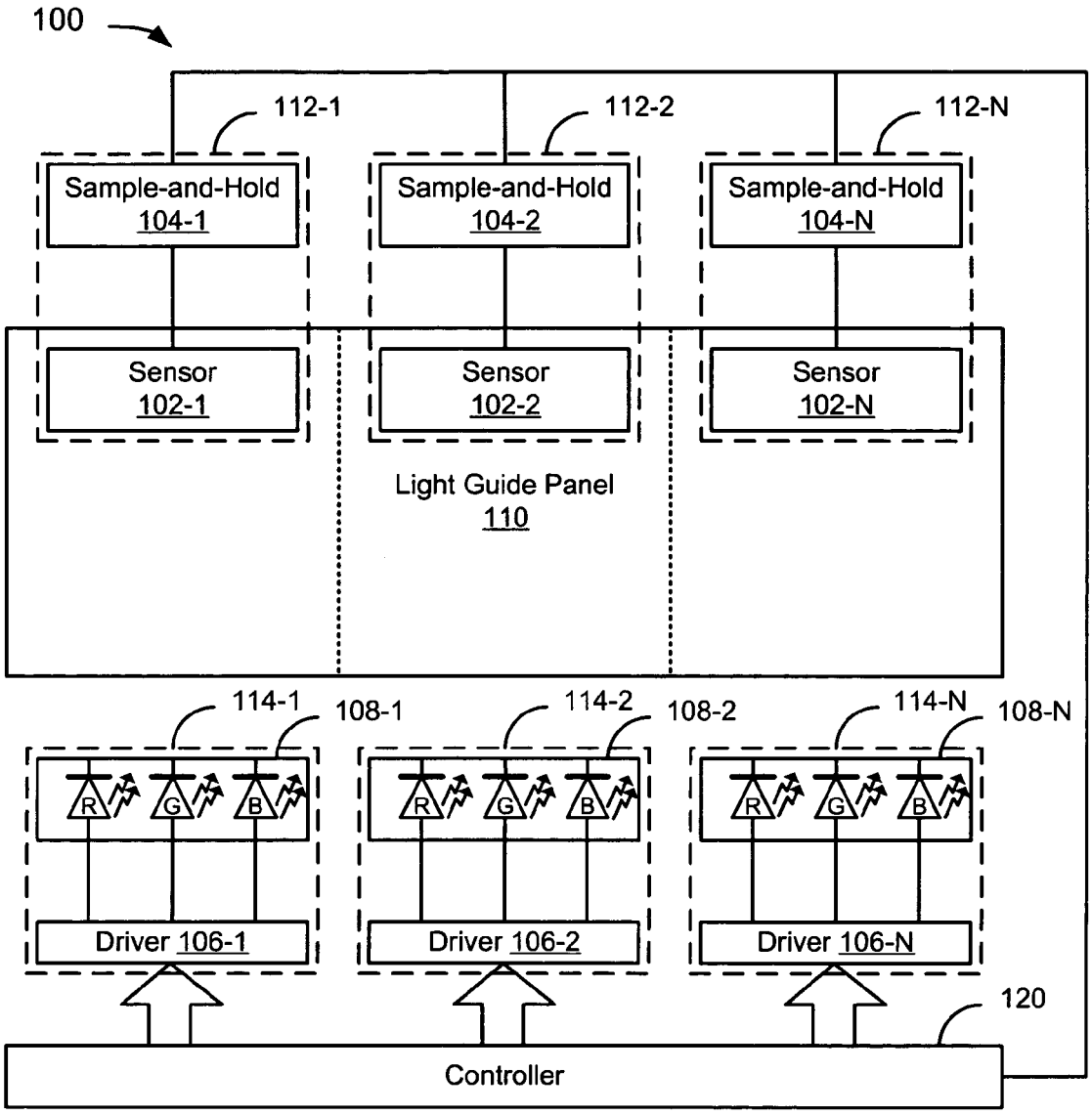
FIG. 1 depicts an exemplary display system.

FIG. 1 depicts an exemplary display system 100. The system 100 includes a light guide panel 110, feedback units 112-1 to 112-N (referred to hereinafter collectively as feedback units 112), light source assemblies 114-1 to 114-N (referred to hereinafter collectively as light source assemblies 114), and a controller 120. The light source assemblies 114 respectively include driver modules 106-1 to 106-N (referred to hereinafter collectively as drivers 106) and light sources 108-1 to 108-N (referred to hereinafter collectively as light sources 108). The feedback units 112 respectively include sensor modules 102-1 to 102-N (referred to hereinafter collectively as sensors 102) and sample-and-hold modules 104-1 to 104-N (referred to hereinafter collectively as sample-and-hold modules 104). The drivers 106 drive the light sources 108 at non-overlapping intervals. The sensors 102 detect luminance and chrominance characteristics of emitted light during the non-overlapping intervals and the feedback units 112 provide light source-specific feedback signals to the controller 120 in response to the detected light. The controller 120 adjusts the drive signals that are provided to the light source assemblies 114 on a per-light source basis in response to the light source-specific feedback signals.

For the purposes of example, the system 100 is a three color ("trichromatic") RGB based system. The colored light of a trichromatic system may be described in terms of tristimulus values, based on matching the three colors such that the colors typically cannot be perceived individually. Tristimulus values represent the intensity of three matching lights, in a given trichromatic system, required to match a desired shade. Tristimulus values can be calculated using the following equations:

$$X = k\sum_{\lambda} W\bar{x}_{\lambda} R_{\lambda}$$

$$Y = k\sum_{\lambda} W\bar{y}_{\lambda} R_{\lambda}$$

$$Z = k\sum_{\lambda} W\bar{z}_{\lambda} R_{\lambda}$$

where $$W\bar{x}_{\lambda} = P_{\lambda} x_{\lambda}$$

$$W\bar{y}_{\lambda} = P_{\lambda} y_{\lambda}$$

$$W\bar{z}_{\lambda} = P_{\lambda} z_{\lambda}$$

-continued $$k = 100 / \sum W y_\lambda$$

The relative spectral power distribution, $P_\lambda$, is the spectral power per constant-interval wavelength throughout the spectrum relative to a fixed reference value. The CIE color matching functions, $x_\lambda$, $y_\lambda$, and $z_\lambda$, are the functions $x(\lambda)$, $y(\lambda)$, and $z(\lambda)$ in the CIE 1931 standard calorimetric system or the functions $x_{10}(\lambda)$, $y_{10}(\lambda)$, and $z_{10}(\lambda)$ in the CIE 1964 supplementary standard colorimetric system. The CIE 1931 standard calorimetric observer is an ideal observer whose color matching properties correspond to the CIE color matching functions between 1° and 4° fields, and the CIE 1964 standard colorimetric observer is an ideal observer whose color matching properties correspond to the CIE color matching functions for field sizes larger than 4°. Reflectance, $R_\lambda$, is the ratio of the radiant flux reflected in a given cone, whose apex is on the surface considered, to that reflected in the same direction by the perfect reflecting diffuser being irradiated. Radiant flux is power emitted, transferred, or received in the form of radiation. The unit of radiant flux is the watt (W). A perfect reflecting diffuser is an ideal isotropic diffuser with a reflectance (or transmittance) equal to unity. The weighting functions, $Wx_\lambda$, $Wy_\lambda$, and $Wz_\lambda$, are the products of relative spectral power distribution, $P_\lambda$ and a particular set of CIE color matching functions, $x_\lambda$, $y_\lambda$, and $z_\lambda$.

Each of the light sources 108 provides light to the light guide panel 110. In the example of FIG. 1, the light sources 108 are LED-based light sources. Two major considerations in mounting LED-based light sources are:

1) each color LED should be sufficiently mixed with other colors of the LED-based light source such that the light guide panel displays mixed light; and
2) the light source should provide even brightness across the light guide panel.

The light sources 108 may provide light to the light guide panel 110 in a timing pattern that is light source-specific. By providing light in a timing pattern, the feedback units 112 provide feedback on the light sources with which they are associated. An exemplary timing pattern is described later with reference to FIG. 4. As previously indicated, the light sources 108 have associated sensors 102 positioned such that light from a light source, e.g., light source 108-1, is received by an associated sensor module, e.g., sensor module 102-1. For illustrative purposes, dashed lines divide the light guide panel 110 into logical areas. The number of logical areas may depend on the size and design of the light guide panel 110, the optical characteristics of the light sources 108, such as radiation pattern and brightness, or other factors. The logical areas serve to show the association between a light source, e.g., light source 108-1, and a sensor module, e.g., sensor module 102-1. Since the areas are logical, one or more light sources 108 may emit light into the entire light guide panel 110, as shown in FIG. 2.

Figure 2:
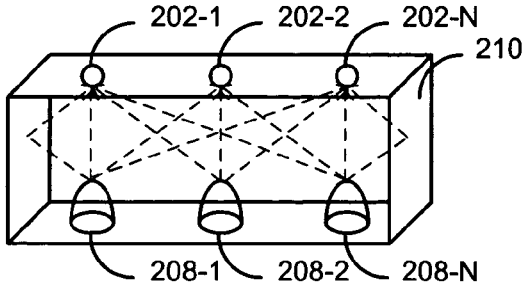
FIG. 2 is a perspective view of an exemplary light guide panel for use with the system of FIG. 1.

FIG. 2 is a perspective view of an exemplary light guide panel 210 with sensor modules 202-1 to 202-N (referred to hereinafter collectively as sensors 202) and light sources 208-1 to 208-N (referred to hereinafter collectively as light sources 208). The light guide panel 210, sensors 202, and light sources 208 are similar to the light guide panel 110 (FIG. 1), sensors 102 (FIG. 1), and light sources 108 (FIG. 1), respectively. As depicted in FIG. 2 for the purposes of example, each of the sensors 202 receives light from each of the light sources 208. Another component (not shown) controls which of the sensors 202 provide feedback, or which feedback is used, as described later. In an alternative, the division of the light guide panel 210 is physical rather than logical. In another alternative, the divisions are partly physical and partly logical.

Referring once again to FIG. 1, the sensors 102 detect light in the light guide panel 110 from associated light sources 108. Sensors 102 may include one or more light-detecting diodes. In an embodiment, the sensors 102 can detect chrominance (e.g., color) and luminance (e.g., intensity or brightness) of light. Two major considerations in mounting the sensors 102 are:

1) the sensor should receive mixed light; and
2) the effect of ambient light on the sensor should be negligible.

The sensors 102 are respectively connected to the sample-and-hold modules 104. Sample-and-hold modules and sample-and-hold techniques are well-known in the art of electronics. Using a sample-and-hold module, an input signal may be held depending upon whether the sample-and-hold module is in a sample mode or a hold mode. With reference to FIG. 1, the sample-and-hold modules 104 receive input signals from the sensors 102 with which they are connected. The sample-and-hold modules 104 also receive control signals, which control whether the sample-and-hold modules 104 are in a sample mode or a hold mode, from the controller 120. The sample-and-hold modules 104 are in sample mode during respective non-overlapping intervals. The sample-and-hold modules 104 are in hold mode at other times. The non-overlapping intervals are described later with reference to FIG. 4. An input signal, when transmitted through a sample-and-hold module, is referred to hereinafter as a feedback signal. The controller 120 receives the feedback signals from the sample-and-hold modules 104.

It should be noted that a sample-and-hold module, e.g., sample-and-hold module 104-1, is used to hold a sensor value while an associated light source, e.g., light source 108-1, is turned off, according to, for example, the timing diagram of FIG. 4, described later. However, if the feedback units 112 are configured to provide accurate feedback to the controller 120 without holding a value, the sample-and-hold modules 104 would not be necessary.

Figure 3A:
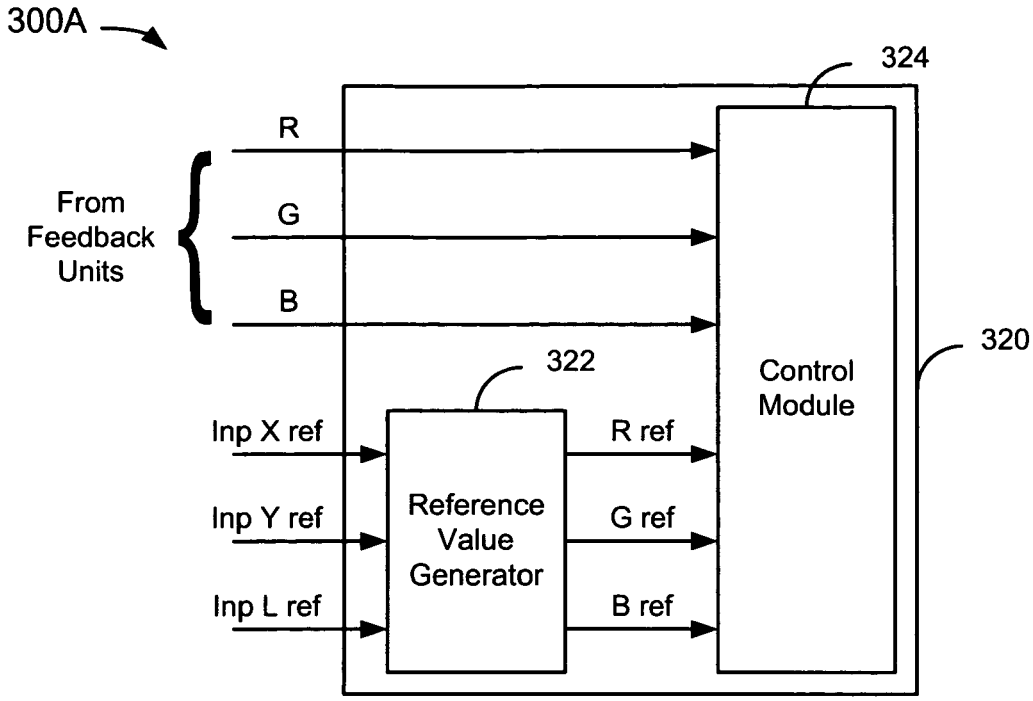
FIGS. 3A and 3B depict exemplary components of a controller for use in the system of FIG. 1.
Figure 3B:
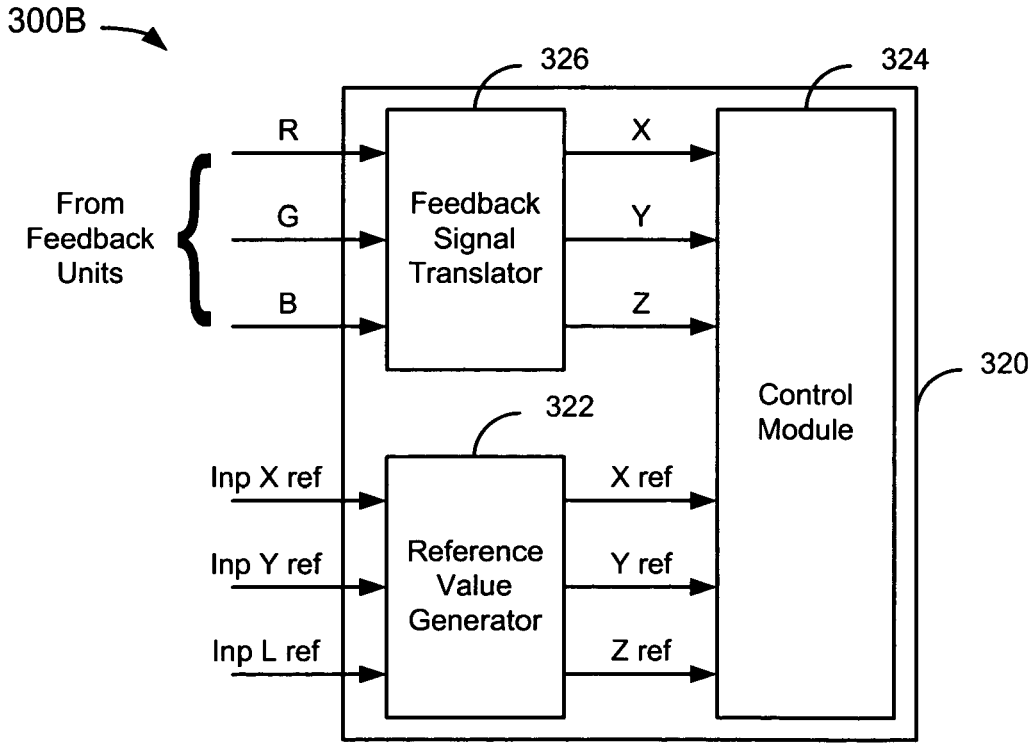

FIGS. 3A and 3B respectively depict systems 300A and 300B, wherein exemplary controllers 320 adjust drive signals using the feedback signals from feedback units. The controllers 320 are embodiments of the controller 120 depicted in FIG. 1. The controller 320 receives feedback from a feedback unit during a non-overlapping interval associated with the feedback unit. Non-overlapping intervals are described later with reference to FIG. 4.

With reference to FIG. 3A, the controller 320 includes a reference value generator 322 and a control module 324. The controller 320 receives feedback signals in the form of measured tristimulus values in RGB space (R, G, and B) from each feedback unit in turn. The controller 320 also receives input reference tristimulus values. The input reference tristimulus values may be in the form of a target white color point (X ref and Y ref) and lumen value (L ref). A user may enter the input reference tristimulus values through a user interface (not shown) or the input reference tristimulus values could be received in some other manner. The reference value generator 322 translates the input reference tristimulus values to reference tristimulus values in RGB space (R ref, G ref, and B ref). The control module 324 then determines the difference between the measured tristimulus values and reference tristimulus values. The controller 320 adjusts drive signals to light sources (not shown) on a per-color basis in response to the comparison. In this way, the luminance and chrominance characteristics of the light sources approach the desired (i.e., reference) luminance and chrominance characteristics.

The alternate system 300B of FIG. 3B is similar to that of the system 300A of FIG. 3A except that it uses CIE 1931 tristimulus values. The system 300B includes a feedback signal translator 326 that translates measured tristimulus values in RGB space to measured CIE 1931 tristimulus values. Additionally, the reference value generator 322 converts input reference tristimulus values to reference CIE 1931 tristimulus values. The control module 324 then determines the difference between the measured CIE 1931 tristimulus values and the reference CIE 1931 tristimulus values and adjusts drive signals on a per-color basis accordingly.

Referring once again to FIG. 1, the controller 120, using the difference between reference values and feedback values, adjusts drive signals associated with the feedback signals on a per-color basis. In an embodiment, each of the light source assemblies 114 receives color-specific drive signals for the colored LEDs. The drivers 106 drive the light sources 108 according to the drive signals. Each of the drivers 106 may include a color-specific driver (not shown) for each colored LED of associated light sources 108. To avoid flickering, the drivers 106 may drive respective light sources 108 at a frequency of 180 Hz (3×60 Hz) or more. In general, the inverse of measurement time during a non-overlapping interval should be greater than or equal to 180 Hz or the inverse of the sum of measurement times should be greater than or equal to 60 Hz. This frequency is sufficient for display panels used for non-backlighting application. For LCD display backlighting, a higher frequency may be required to avoid LCD display image flickering.

The controller 120 provides drive signals to the respective light source assemblies 114 during non-overlapping intervals associated with the respective light source assemblies 114. Accordingly, the controller 120 may be required to maintain drive values for each of the light source assemblies 114. The controller 120 provides color-specific drive signals to the drivers 106, according to the drive values maintained by the controller 120. The drive values may represent drive voltages or drive signal durations. If the drive value is a drive voltage, the drive voltages for each color LED are dynamic, but voltage for each color LED is constant over a period of time (e.g., the non-overlapping interval associated with the assembly). If the drive value is a drive signal duration, the drive voltages for each color LED are static, but the drive voltage is provided for the indicated signal duration (e.g., during a portion of the non-overlapping interval associated with the assembly).

Figure 4:
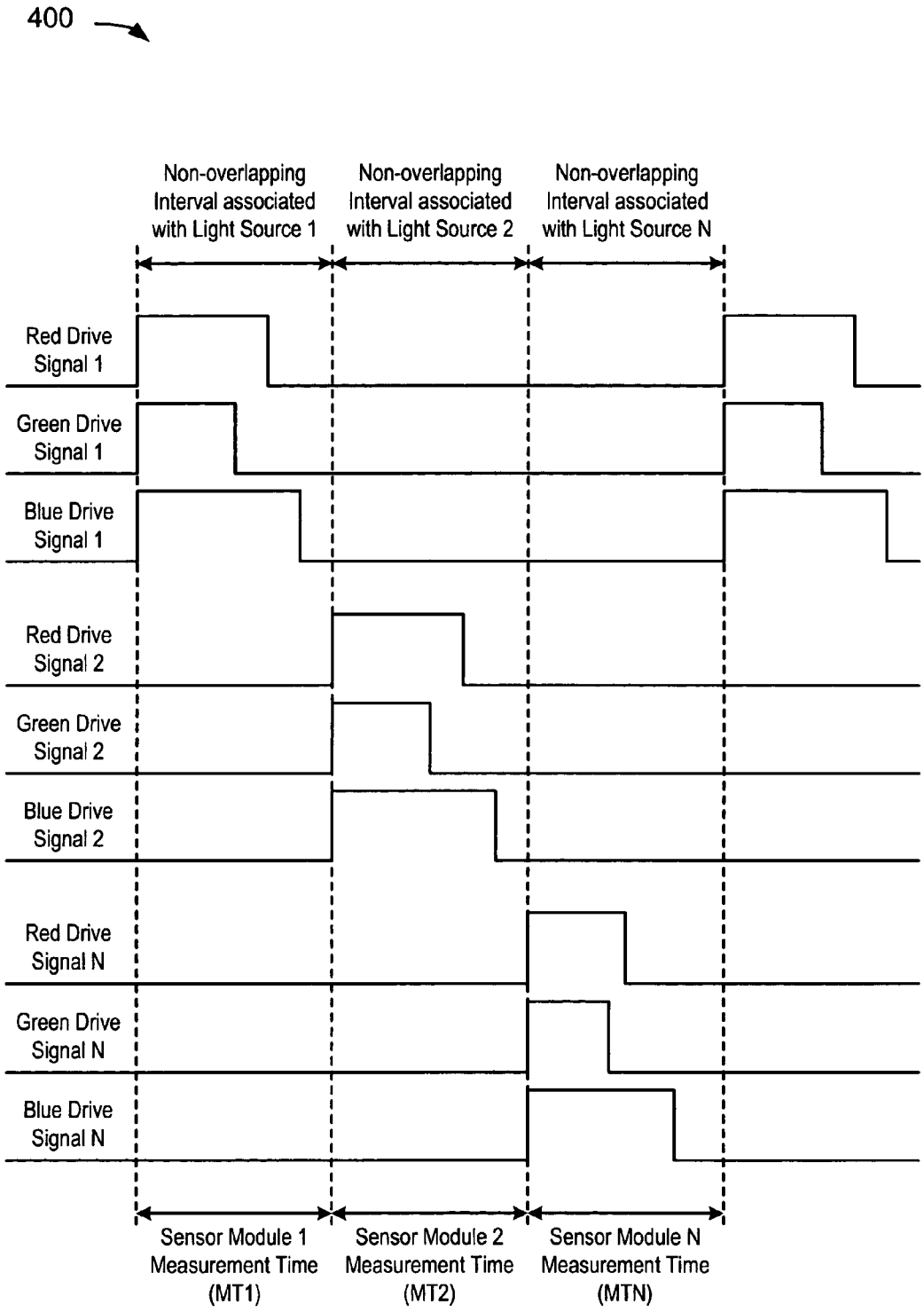
FIG. 4 depicts a timing diagram in which a drive value associated with each light source of FIG. 1 is a signal duration.

FIG. 4 depicts a timing diagram 400 in which drive values associated with respective light sources are drive signal durations. The timing diagram 400 includes non-overlapping intervals for light source 1, light source 2, and light source N and measurement times for sensor module 1 (MT1), sensor module 2 (MT2), and sensor module N (MTN) that respectively span the non-overlapping intervals. A light source assembly receives a tristimulus drive signal from a controller during a non-overlapping interval. The tristimulus drive signals drive the colored LEDs of the light source assembly on a per-color basis. In response to the color-specific drive signals, the light source emits light into a light guide panel according to the tristimulus drive signal. A sensor detects luminance and chrominance characteristics of the light during the sensor module's measurement time, e.g., MT1, and a sample-and-hold module provides feedback to the controller.

In the example of FIG. 4, the tristimulus drive signal for each light source includes color-specific drive signals (e.g., red, green, and blue). A red drive signal of a tristimulus drive signal drives the red LED of the light source. A green drive signal drives the green LED of the light source. A blue drive signal drives the blue LED of the light source.

The tristimulus drive signals driving each light source are high for a variable duration that depends on the drive signal duration associated with each of the colors. For example, in MT1, the red, green, and blue drive signals associated with the light source 1 are of differing durations. This causes the red, green, and blue LEDs of the light source 1 to emit light for differing durations. The light sources 2 to N behave similarly, but have different non-overlapping intervals from that of the light source 1.

The timing diagram 400 may cycle through non-overlapping intervals repeatedly, providing continuous feedback. Alternatively, the timing diagram 400 could represent a period (e.g., an initialization period) of non-overlapping intervals, presumably followed by overlapping intervals wherein the light sources emit light simultaneously.

Figure 5A:
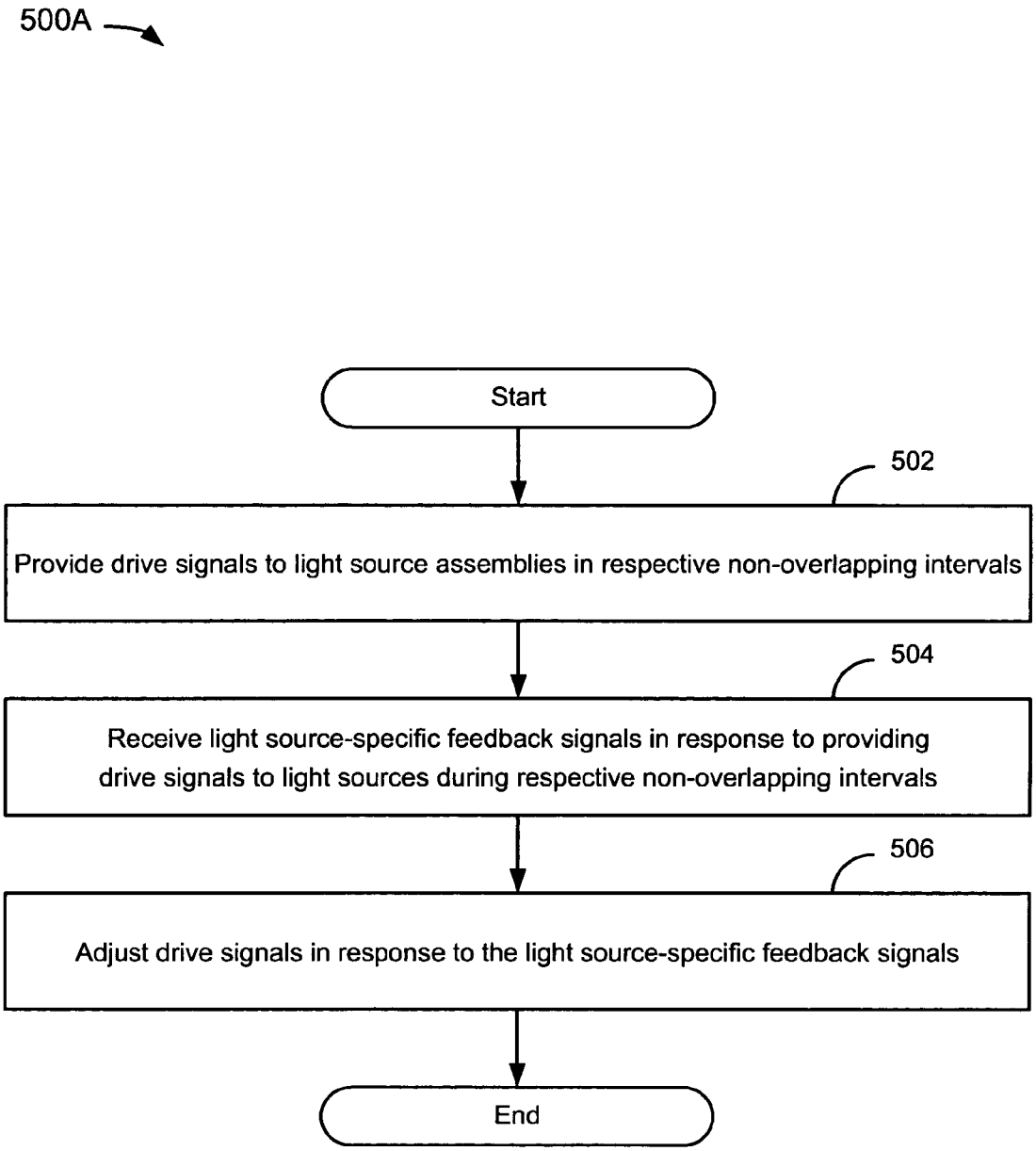
FIGS. 5A and 5B are flowcharts of methods of controlling luminance and chrominance characteristics in the system of FIG. 1.

FIG. 5A is a flowchart 500A of a method of controlling an LED-based light system. At step 502, drive signals are provided to light source assemblies during respective non-overlapping intervals. At step 504, light source-specific feedback signals are received in response to providing drive signals to light sources during respective non-overlapping intervals. At step 506, drive signals are adjusted in response to the light source-specific feedback signals. An example of adjusting the drive signals involves acquiring differences between the light source-specific feedback signals and a reference value and adjusting the drive signals on a per-color basis to compensate for the differences. The light source-specific feedback signals and the reference value may initially be of different formats. Accordingly, the light source-specific feedback signal, the reference value, or both the light source-specific feedback signal and the reference value may be translated into a different format, such as CIE 1931 standard colorimetric tristimulus values. If the drive signals are voltages, compensating for the differences may involve increasing or decreasing the voltages. Alternatively the drive signals may be provided for longer or shorter periods of time.

The steps of flowchart 500A could be performed as an initialization procedure that ends with step 506 or repeats for a limited number of times. Alternatively, the flowchart 500A could repeat from start to end for continuous feedback. In this case, the drive signals are provided in repeated sequential non-overlapping intervals. Moreover, each light source assembly could be considered in turn prior to considering a next light source assembly.

Figure 5B:
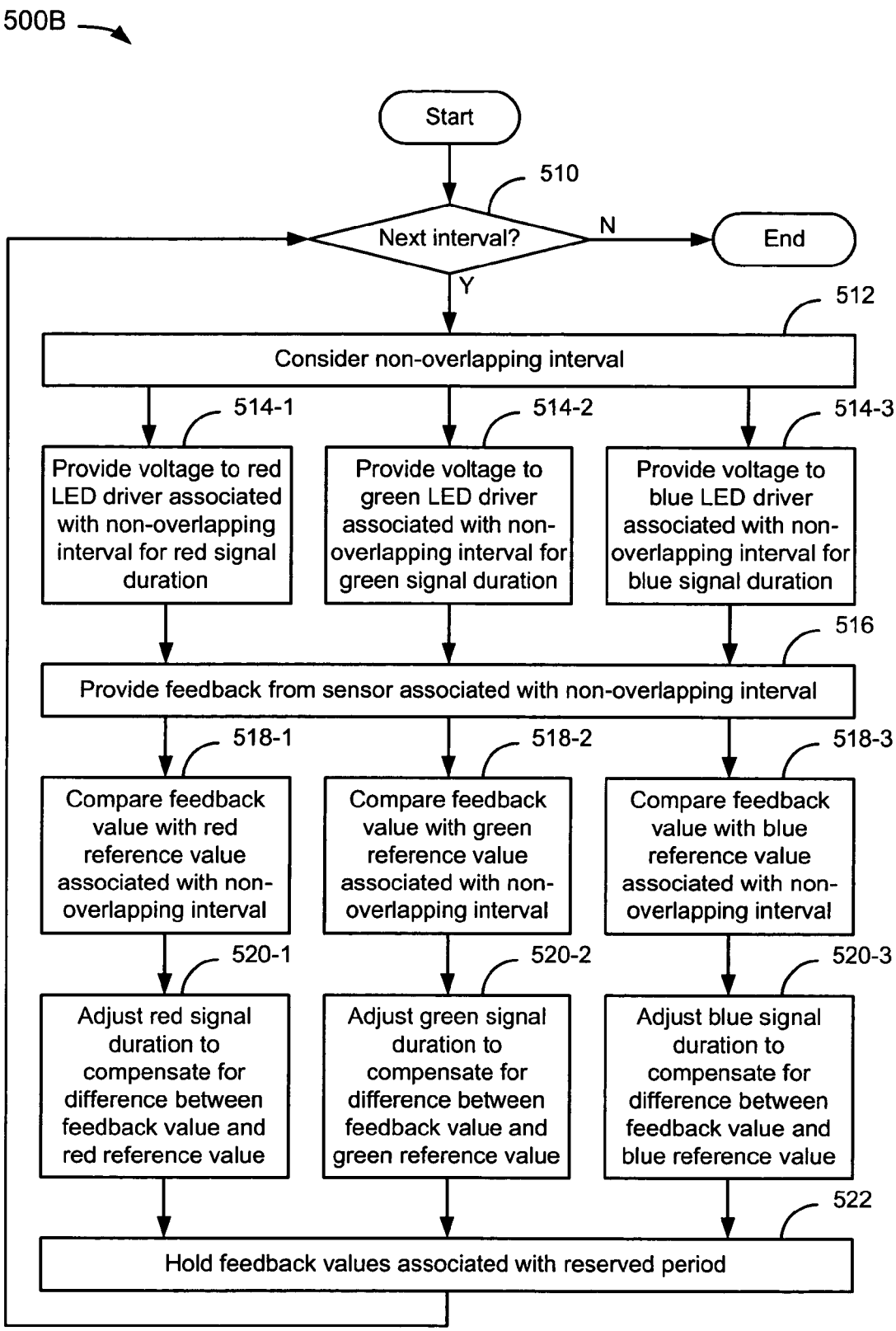

FIG. 5B illustrates a flowchart 500B wherein each light source assembly is considered in turn. The flowchart 500B starts at decision point 510 where it is determined whether it is time to consider a next non-overlapping interval. If there are no more non-overlapping intervals, the flowchart 500B ends. Otherwise, a next non-overlapping interval is considered at step 512 and the flowchart 500B continues as indicated. It should be noted that the flowchart 500B need not end if continuous feedback is desired for a system.

Steps 514-1 to 514-3 may occur at substantially the same time, though often for different durations. At step 514-1, provide voltage to a red LED driver associated with the non-overlapping interval. The voltage is provided for a red signal duration. The duration of the red signal varies depending upon the desired intensity of red light. Steps 514-2 and 514-3 are similar to step 514-1, but for green and blue, respectively.

At step 516, provide feedback from a sensor associated with the non-overlapping interval. While any sensor may or may not detect luminance and chrominance characteristics during the non-overlapping interval, the luminance and chrominance characteristics should only be provided as feedback if the sensors are associated with the non-overlapping interval.

Steps 518-1 to 518-3 may occur at substantially the same time. At step 518-1, compare the feedback value for red color with a red reference value. The feedback value may be a tristimulus value that includes a red color value, or the red color value could be derived from a mixed light signal. Steps 518-2 and 518-3 are similar to step 518-1, but for green and blue color, respectively.

Steps 520-1 to 520-3 may occur at substantially the same time. At step 520-1, adjust the red signal duration to compensate for difference between the red feedback value and the red reference value. If the red feedback value is less than the red reference value, the red signal duration is increased. If the red feedback value is greater than the red reference value, the red signal duration is decreased. If the red feedback value and the red reference value are equal or if the red reference value is within an acceptable lower or upper bound of the reference value, the red signal duration is unchanged. Note that increasing the red signal duration may involve adjusting a timer, a register, or some other software or hardware variable value. Thus, the red signal may not be provided for some time after the red signal duration is adjusted. Steps 520-2 and 520-3 are similar to step 520-1, but for green and blue color, respectively. Typically, the adjusted signal durations take effect during the next corresponding non-overlapping interval.

At step 522, hold the feedback values associated with the non-overlapping interval. The feedback values associated with a non-overlapping interval are held when the non-overlapping interval comes to an end so as not to interfere with the next non-overlapping interval. It should be noted that step 522 could occur after step 516, prior to comparing feedback values with reference values (at step 518).

Light source assemblies, as used herein, may include one or more light sources and one or more driver modules. Though RGB based light sources are described herein, various colors, such as cyan and amber, could be used instead. The light sources may include LEDs of one or more colors. The light sources may include one or more LED dies (or chips) of each color. The driver modules may include one or more light source drivers. The light source drivers may include one or more transistors.

Feedback units, as used herein, may include sensors and sample-and-hold modules. Sample-and-hold modules allow the feedback units to transmit feedback signals during non-overlapping intervals that are associated with the feedback unit and to hold the feedback signals at other times. A feedback unit may include an amplifier. In an alternative, some other mechanism to ensure feedback signals from the feedback units may be used. The important consideration in applying such a mechanism is that feedback from a given feedback unit during a non-overlapping interval that is not associated with the given feedback unit is discarded.

Drive signal, as used herein, may include control voltage or current. Control voltages may be higher or lower depending on the amount of light output desired. Alternatively, the duration of a control voltage may be increased or decreased depending on light output desired. The latter technique is called pulse width modulation (PWM).

A reference value, as used herein, may be derived from input by a user or preset. If a reference input is received, it must typically be translated to another format, such as a CIE 1931 tristimulus values. It may also be translated to a tristimulus value in RGB space. The reference value itself may include values for each color (e.g., RGB). The reference value may include a lumen value. The components of the reference value are not critical so long as the reference value can be compared to the feedback signal in a meaningful way.

A display panel, as used herein, is divided into multiple areas. Each area is associated with a luminary and a sensor. The division may be logical or physical. The display panel may include a light guide, such as a light guide panel. A light guide is a device that is designed to transport light from a luminary to a point at some distance with minimal loss. Light is transmitted through a light guide by means of total internal reflection. Light guides are usually made of optical grade materials, such as acrylic resin, polycarbonate, epoxies, and glass.

Non-overlapping intervals, as used herein, refer to the times during which a light source illuminates all or part of a display panel. The light source is associated with a feedback point that transmits light source-specific (or light source assembly-specific) feedback signals related to luminance and chrominance characteristics detected in the display panel. A controller cycles through the non-overlapping intervals one or more times and adjusts luminance and chrominance characteristics of the light sources using the light source-specific feedback.

Although specific embodiments of the invention have been described and illustrated, the invention is not to be limited to the specific forms or arrangements of parts as described and illustrated herein. The invention is limited only by the claims.

What is claimed is:

1. A control system for a Light Emitting Diode (LED) based light system, comprising:

a plurality of light source assemblies, each light source assembly comprising a light source of a first color and a light source of a second color, the first and second colors being different;

a plurality of feedback units for generating feedback signals representative of luminance and chrominance characteristics; and a controller in signal communication with said plurality of feedback units configured to provide drive signals to the light source assemblies during respective non-overlapping intervals such that a light source of the first color in a first light source assembly and a light source of the first color in a second light source assembly are driven at non-overlapping intervals and such that a light source of the second color in the first light source assembly and a light source of the second color in the second light source assembly are driven at non-overlapping intervals and to adjust said drive signals on a per-light source assembly and a per-light source basis in response to feedback signals from said plurality of feedback units.

2. The system of claim 1, wherein a feedback unit of said feedback units further comprises:

a sensor for sensing luminance and chrominance characteristics during one of said non-overlapping intervals, wherein said non-overlapping interval is associated with said sensor and with one of said light source assemblies.

3. The system of claim 1, wherein a feedback unit of said feedback units further comprises:

a sample-and-hold module for sampling feedback signals from a sensor during a non-overlapping interval of said non-overlapping intervals and holding feedback signals during other non-overlapping intervals, wherein said non-overlapping interval is associated with said sample-and-hold module.

4. The system of claim 1, wherein each light source assembly further comprises a light source of a third color, wherein the first color is red, the second color is green, and the third color is blue and wherein the drive signals are provided such that a light source of the third color in the first light source assembly and a light source of the third color in the second light source assembly are driven at non-overlapping intervals.

5. The system of claim 1, wherein:

said controller acquires differences between said feedback signals and a reference value and adjusts said drive signals on a per-color basis to compensate for said differences.

6. The system of claim 5, further comprising:

a reference value generator for converting a reference input to CIE 1931 tristimulus reference values; and a feedback signal translator for converting a feedback signal of said feedback signals to CIE 1931 tristimulus measured values, wherein said controller acquires differences between said feedback signals and a reference value by determining a difference between said CIE 1931 tristimulus reference values and said CIE 1931 tristimulus measured values for each of said feedback signals.

7. The system of claim 5, further comprising:

a reference value generator for:

converting a reference input to CIE 1931 tristimulus reference values; and translating said CIE 1931 tristimulus reference values to tristimulus reference values in RGB space, wherein said controller acquires differences between said feedback signals and a reference value by determining a difference between said tristimulus reference values in RGB space and said feedback signals.

8. The system of claim 1, further comprising:

a light guide panel for directing light from said light source assemblies to said feedback units, wherein said feedback units provide feedback related to luminance and chrominance characteristics within said light guide panel related to light source assemblies with which said feedback units are associated.

9. The system of claim 1, wherein:

said controller provides said drive signals for a signal duration no longer than said non-overlapping interval; and said controller adjusts said drive signals on a per-color basis by changing said signal duration from a first duration to a second duration, wherein said second duration is no longer than said non-overlapping interval.

10. A method for controlling a Light Emitting Diode (LED) light system, comprising:

providing drive signals to a plurality of light source assemblies during respective non-overlapping intervals, wherein each light source assembly comprises a light source of a first color and a light source of a second color with the first and second colors being different, the drive signals being provided to the light source assemblies such that a light source of the first color in a first light source assembly and a light source of the first color in a second light source assembly are driven at non-overlapping intervals and such that a light source of the second color in the first light source assembly and a light source of the second color in the second light source assembly are driven at non-overlapping intervals;

receiving light source assembly-specific and color-specific feedback signals in response to said providing drive signals to the plurality of light source assemblies during respective non-overlapping intervals; and adjusting said drive signals on a per-light source assembly and a per-color basis in response to the light source assembly-specific and color-specific feedback signals.

11. The method of claim 10, wherein said providing includes:

providing said drive signals in repeating sequential non-overlapping intervals.

12. The method of claim 10, wherein said adjusting includes:

acquiring differences between said light source-specific feedback signals and a reference value; and adjusting said drive signals on a per-color basis to compensate for said differences.

13. The method of claim 10, further comprising:

receiving a reference input;

converting said reference input to said reference value;

comparing said reference value to said light source-specific feedback signals.

14. The method of claim 10, further comprising:

receiving a reference input;

converting said reference input to said reference value, wherein said reference value includes CIE 1931 tristimulus values;

converting said light source-specific feedback signals to CIE 1931 tristimulus values; and comparing said reference value to said light source-specific feedback signals.

15. The method of claim 10, further comprising:

generating said light source-specific feedback signals according to luminance and chrominance characteristics of light from said light sources.

16. A Light Emitting Diode (LED) based light system, comprising:

a plurality of light source assemblies, each light source assembly comprising a red LED, a green LED, and a blue LED;

a plurality of feedback units, each of the feedback units being in optical communication with at least one of the light source assemblies; and a controller in signal communication with the light source assemblies and the feedback units and configured to:

provide drive signals to the light source assemblies at non-overlapping intervals such that a red LED in a first light source assembly and a red LED in a second light source assembly are driven at non-overlapping intervals, such that a green LED in the first light source assembly and a green LED in the second light source assembly are driven at non-overlapping intervals, and such that a blue LED in the first light source assembly and a blue LED in the second light source assembly are driven at non-overlapping intervals;

receive light source assembly-specific and color-specific feedback signals from the feedback units in response to the drive signals that are provided at non-overlapping intervals; and adjust the drive signals provided to the light source assemblies on a light source assembly-specific and a color-specific basis in response to the light source assembly-specific and color-specific feedback signals.

17. The LED-based light system of claim 16 wherein the feedback units include color sensors for detecting luminance and chrominance characteristics of light.

18. The LED-based light system of claim 16 wherein the feedback units include color sensors for generating color-specific feedback signals.

19. The LED-based light system of claim 18 wherein the controller is configured to provide light source assembly-specific and color-specific drive signals to the light sources in response to the light source assembly-specific and color-specific feedback signals.

20. The LED-based light system of claim 16 wherein:

the feedback units include color sensors for generating color-specific feedback signals; and the controller is configured to provide light source assembly-specific and color-specific drive signals to the light source assemblies in response to the light source assembly-specific and color-specific feedback signals.

* * * * *